US006362432B1

(12) United States Patent
LaPidus et al.

(10) Patent No.: US 6,362,432 B1
(45) Date of Patent: Mar. 26, 2002

(54) FLEXIBLE POWER AND CONTROL CABLE FOR HIGH NOISE ENVIRONMENTS

(75) Inventors: Steven G. LaPidus, Riverton, NJ (US); Hartmut Kaletsch, Forchheim (DE); Thomas Reuss, Coburg (DE); Ulricke Vogt, Ahorn (DE)

(73) Assignee: Pirelli Kabel und Systeme GmbH & Co. KG, Berlin (DE)

( * ) Notice: Subject to any disclaimer, the term of this patent is extended or adjusted under 35 U.S.C. 154(b) by 0 days.

(21) Appl. No.: 09/645,930

(22) Filed: Aug. 25, 2000

Related U.S. Application Data

(63) Continuation of application No. PCT/EP99/01240, filed on Feb. 26, 1999.
(60) Provisional application No. 60/076,367, filed on Feb. 27, 1998.

(51) Int. Cl.[7] ..... H01B 11/00
(52) U.S. Cl. ..... 174/113 R; 174/116
(58) Field of Search ..... 174/113 R, 113 C, 174/131 A, 116, 120 R, 120 C, 36

(56) References Cited

U.S. PATENT DOCUMENTS 3,211,821 A * 10/1965 Wakefield ..... 174/26 R
3,699,238 A * 10/1972 Hansen et al. ..... 174/116 X
4,002,820 A * 1/1977 Paniri et al. ..... 174/116 X
4,356,139 A * 10/1982 Rowland et al. ..... 264/174
4,684,214 A * 8/1987 Goldmann et al. .. 174/120 C X
5,864,094 A * 1/1999 Griffin ..... 174/105 R
6,188,026 B1 * 2/2001 Cope et al. ..... 174/120 R

FOREIGN PATENT DOCUMENTS

DE 31 51 234 6/1983
DE 33 26 986 2/1985

* cited by examiner

*Primary Examiner*—Chau N. Nguyen
(74) *Attorney, Agent, or Firm*—Finnegan, Henderson, Farabow, Garrett & Dunner, L.L.P.

(57) ABSTRACT

A flexible power cable includes a plurality of power conductors each having insulation thereon and being arranged to form interstices between adjacent ones of the power conductors. Each of the power conductors includes a plurality of conductor strands. An insulated grounding conductor is provided in each interstice and together with the power conductors define a conductor bundle. An inner jacket surrounds the conductor bundle. A flexible, braided sheath member surrounds the inner jacket and is constructed and arranged to limit transmission and susceptibility to electromagnetic and radio frequency interference. An outer polymeric jacket surrounds the braided sheath member. The insulation of the power conductors and of the grounding conductors is lubricated so that the power conductors and the grounding conductors may move relative to each other and with respect to the inner jacket upon flexing of the cable.

18 Claims, 1 Drawing Sheet

FLEXIBLE POWER AND CONTROL CABLE FOR HIGH NOISE ENVIRONMENTS

RELATED APPLICATIONS

This application is a continuation of International Application No. PCT/EP99/01240, filed Feb. 26, 1999; and claims the benefit of priority under 35 U.S.C. §119 of U.S. provisional patent application Serial No. 60/076,367, filed Feb. 27, 1998 now abandoned.

BACKGROUND OF THE INVENTION

This invention relates to a power cable and more particularly, to a flexible power cable for use between motor control devices and the motors they control, which minimizes electromagnetic noise and radio frequency interference.

DESCRIPTION OF RELATED ART

Electromagnetic noise and radio frequency interference (EMI/RFI) can create problems in the control of electronic circuits. More recently, EMI/RFI have been a problem in variable frequency drive applications. Power cables for variable frequency drive devices have caused EMI/RFI crosstalk on adjacent controls and instrumentation cables.

In the past, equipment manufacturers had only to worry about interference caused by normal AC current flowing in a power supply circuit. With the recent advances in transistor and semiconductor thyristor technology, and their application in variable frequency drives, the type of signals utilized to provide power to the motor from their controllers has changed the source of the EMI/RFI that must be protected against.

Conventionally, power, controls and instrumentation cables were placed in segregated cable support systems such as cable trays, conduits, duct banks or direct burial trenches which were separated by minimum distances as required by particular standards in order to minimize the effects of the electromagnetic interference. For fixed cable applications, the power cable could be manufactured with an overall armor consisting of lead, corrugated aluminum, copper or bronze or with an overall sheath consisting of wires and tapes made of copper, aluminum, bronze or steel. This reduces the EMI/RFI transmission by the power cable.

Conventional power cables have been manufactured with standardized levels of insulation thicknesses which were not calculated to handle the additional voltage and current spike levels produced by the new generation of controls. Thus, voltage and current spikes may damage the conventional cables and result in motor controller, cable and motor failures.

On equipment with moving sections such as cranes, machine tools, and robots, the power, control and instrumentation cable types are typically placed in close proximity on mechanical cable handling equipment such as festoons, reels, cable tracks and tenders. On this type of equipment, there is limited amounts of separation, if any, and the cables cannot have a solid armor or taped sheath which are not designed to flex. Equipment manufactures have, in the past, utilized standard unarmored or unshielded four conductor flexible motor feed cables in these types of applications. The use of four conductor power cable configurations limits the ability of the cable manufacturer to take advantage of the optimum cancellation effects of trefoil conductor assembly.

Adding an overall armor or tape sheath in order to minimize the effects of the EMI that was produced by the normal AC currents flowing in the power circuit is generally limited to the fixed applications. The cable with an overall armor or tape sheath cannot be applied to a flexible cable application because the extra armor or sheath layer is not designed to be flexible. An armored cable will not flex and a tape sheath will generally only flex to a limited amount during which the tapes will separate and destroy the sheath and cable.

In the published prior art, DE-A-3151234 discloses a flexible power cable comprising conductors which are arranged around a central dummy conductor. An inner jacket and an outer jacket are provided. Between the actual conductors a so-called separation layer is provided which is made of wax or talc or mica. However, the inner jacket does not surround a conductor bundle but fills the spaces between the conductors. No grounding conductors are mentioned.

Furthermore, DE-A-3 326 986 shows a cable construction where conductors are surrounded by an insulation and further conductors as well as protection conductors and rubber enforcements are provided within a conductor coating which lies underneath an outer jacket. Interstices are filled with an oil graphite.

Accordingly, there is a need to provide a flexible power cable for use between motor control devices and the motors that they control, which minimizes electromagnetic noise and radio frequency interference and is capable of withstanding voltage or current spikes produced by the devices.

SUMMARY OF THE INVENTION

This object is achieved by providing a flexible power cable including a plurality of power conductors, each having insulation thereon and being arranged to form interstices between adjacent ones of the power conductors. Each of the power conductors includes a plurality of conductor strands. An insulated grounding conductor is provided in each interstice and together with the power conductors define a conductor bundle. An inner jacket surrounds the conductor bundle. A flexible, braided sheath member surrounds the inner jacket and is constructed and arranged to limit transmission and susceptibility to electromagnetic and radio frequency interference. An outer jacket surrounds the braided sheath member. The insulation of the power conductors and of the grounding conductors is lubricated so that the power conductors and the grounding conductors may move relative to each other and with respect to the inner jacket upon flexing of the cable.

Preferably, each of said power and/or grounding conductors can include a plurality of conductor strands.

Preferably, said outer jacket is a polymeric jacket.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawing, all of which form a part of this specification.

DETAILED DESCRIPTION OF THE PRESENTLY PREFERRED EXEMPLARY EMBODIMENTS

Figure 1:
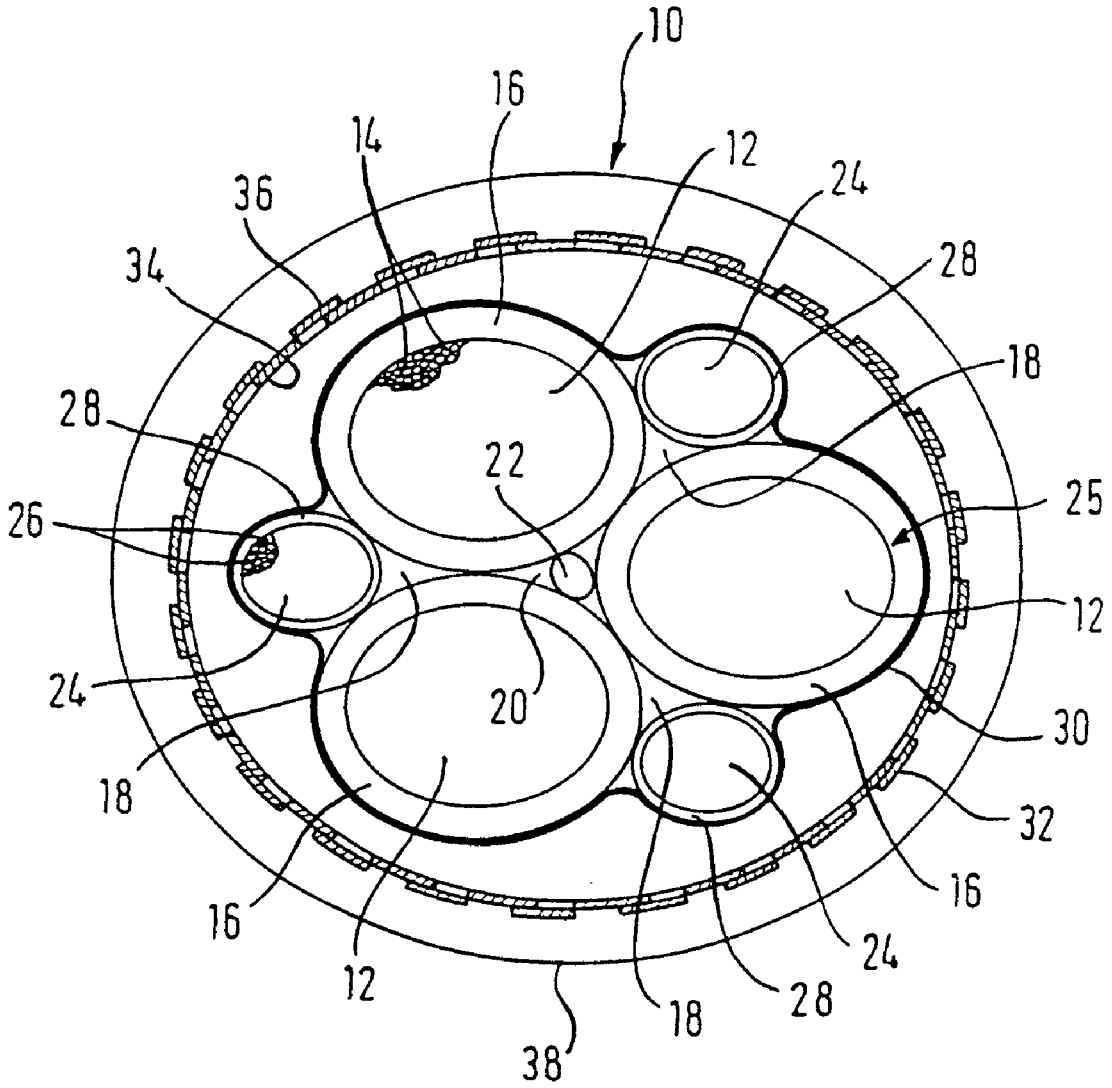
FIG. 1 is an enlarged end view of a flexible power cable provided in accordance with the principles of the present invention.

A flexible cable provided in accordance with the principles of the present invention is shown, generally indicated at 10, in FIG. 1. The cable 10 includes three power conductors 12, each including a plurality of current conducting tinned copper wire strands 14. Although FIG. 1 shows only a portion of the wire strands 14 for ease of illustration, it can be appreciated that each power conductor 12 comprises wire strands 14. Each of the wire strands 14 of a single power conductor 12 has a common diameter in the range of approximately 0.15 mm to 0.30 mm. For example, for an 18 AWG power conductor 12, there are 51 wire strands, each 0.15 mm diameter (35 AWG) for a 12 AWG power conductor, there are 199 wire strands, each of 0.15 mm diameter (35 AWG). For a 6 AWG power conductor, there are 451 wire strands, each of 0.20 mm diameter (AWG 32), and for a #2/0 AWG power conductor, there are 1002 strands, each of 0.30 mm diameter (AWG 29). Many other sizes of the power conductors 12 may be provided between a range of, for example, 18 AWG and #2/0 AWG.

The use of fine wire strands 14 to comprise the power conductors 12 increases the flexibility of the power conductors 12. The number of wire strands 14 used for the power conductors 12 of the invention is greater than that used for conventional power conductors of the same gage, and the diameter of the wire strands 14 is less than the diameter of strands of conventional power conductors of the same gage. Furthermore, the lay of the wire strands 14 is shorter than that of strands of conventional power conductors of the same gage.

Each of the power conductors 12 has an insulation over the overall strand of a predetermined material 16 having a predetermined thickness. For example, each of the power conductors 12 may have a color-coded insulation over the overall strand of, for example, crossed-linked polyethylene material 16 having a thickness which may depend upon the size of the power conductor 12.

Furthermore, as another example, each of the power conductors 12 can have insulation over the overall strand of either thermoplastic or elastomeric material. The insulation material for the cable can also be selected based on its application. As aforementioned, one example can be polyethylene, which can be utilized for extremely flexing applications. Another example is ethylene propylene rubber (EPR) which can be utilized for hard usage applications, especially outdoors. The insulation thickness can depend upon the size of the power conductor 12 and the material utilized.

For example, the insulation thickness for power conductor 12 sized between 30 AWG and 9 AWG is about 0.8 mm, the insulation thickness is about 1.2 mm for a power conductor size of 8 AWG and the insulation thickness is about 1.6 mm for power conductor sizes between 7 AWG and #2/0 AWG. The thickness of the insulation material 16 is designed to provide the dielectric strength to meet peak voltage requirements.

The voltage rating of the cable 10 is approximately 600–1000 volts with a maximum continuous AC voltage of 700–1200 volts and a maximum peak voltage of about 1700 volts. This maximum peak voltage may be produced when the cable 10 is used with variable frequency drives. A cable 10 of the invention has been tested to over 3000 volts.

Polyethylene can be selected as the insulation material 16 of the power conductors 12 since, for the same thickness as the conventionally employed PVC insulation material, the electrical strength of the polyethylene material 16 is about twice as great as that of the PVC material.

For example, preferably, cross-linked polyethylene is selected as the insulation material 16 of the power conductors 12 in extremely flexible applications since, for the same thickness as the conventionally employed PVC insulation material, the electrical strength also of the cross-linked polyethylene material 16 is about twice as great as that of the PVC material. In heavy duty applications, preferably EPR insulation can be utilized due to its outstanding ability to withstand the environmental factors present in its application, such as chemicals, oils, etc.

In the preferred embodiment, three insulated power conductors 12 are disposed in a trefoil arrangement defining interstices 18 and a central opening 20. However, other numbers of insulated power conductors 12 may be combined to form interstices and a central opening with different sizes by comparison to the trefoil arrangement.

In the illustrated embodiment, a central strain or support messenger 22 comprised of flexible plastic or rubber material is disposed in the central opening 20 and provides support and guidance of the power conductors during force guided flexing applications. The support messenger 22 is generally only employed in large power cable 10 configurations and separates the power conductors 12 preventing them from collapsing on each other, which in turn assures that the power cables 12 are free to move within with respect to other cable components, as will be explained more fully below.

A grounding conductor 24 is disposed in each interstice 18 and together with the power conductors 12 define a conductor bundle, generally indicated at 25. Each grounding conductor 24 comprises a plurality of tinned cooper wire strands 26, with the overall conductor being insulated with crossed linked polyethylene material 28. As a further example, the overall conductor can be generally insulated with the same material as the power conductor. Although FIG. 1 shows only a portion of the wire strands 26 for ease of illustration, it can be appreciated that the entire grounding conductor 24 comprises wire strands 26. In the illustrated embodiment, three grounding conductors 24 are disposed in a trefoil arrangement. Each grounding conductor 24 has an insulation thickness of about 0.4 mm to enable the components of the cable 10 to move freely without being destroyed by abrasion which may occur when the grounding conductors are bare or uninsulated.

In the illustrated embodiment, each of the power conductors 12 is 12 AWG and each of the grounding conductors 24 is 18 AWG.

With reference to FIG. 1, an inner jacket 30 of PVC material surrounds the conductor bundle 25 to protect power conductors 12 and the grounding conductors 24, and to provide an isolated shield. In the hard usage design, preferably, the inner jacket material can be ethylene propylene rubber (EPR). The wall thickness of the inner jacket 30 is represented by $0.02 \times d + 0.06$ mm, where d is the diameter under the inner jacket 30.

To ensure that the power conductor 12 and grounding conductors 24 may move relative to each other and to the inner jacket 30 as needed with induced tension and torsional forces in flexing applications, a lubricant is provided. In the illustrated embodiment, the insulation of each power conductor 12 and the insulation of each grounding conductor 24 is coated with talc or other lubricating powder. Other lubricants such as wet lubricants or soaps may be used. In certain applications, such as for use in powering devices in food processing, it is not preferable to have talc within the cable 12 since the talc may escape from the cable ends and contaminate food being processed. Thus, it is within the contemplation of the invention to provide a dry lubricant directly in the insulation material of each power conductor 12 and each grounding conductor 24 to ensure movement of the conductors relative to the inner jacket 30.

A flexible, tinned copper braided sheath 32 comprising tinned copper wires arranged in the conventional crossed-hatch arrangement surrounds the inner jacket 30 to provide flexibility to the cable 10, to increase the strength thereof, and to minimize EMI/RFI in the cable 10. The tinned copper wires can be arranged in a high percentage coverage crossed-hatch arrangement which is optimized to preferably minimize EMI/RFI over the 0 to 100 MHz frequency range. In the illustrated embodiment, the braided sheath 32 includes a thin polyester foil 34 disposed adjacent to the inner jacket 30 an d an outer plastic coating 36 on the sheath copper wires disposed adjacent an outer jacket 38.

The outer jacket 38 surrounds the braided sheath 32. In the illustrated embodiment, the outer jacket 38 is a transparent PVC material which is resistant to petrochemicals. In the hard usage design, the outer jacket can be black chloropene rubber (PCP) which is resistant to UV (ultraviolett light) and petrochemicals. The outer plastic coating 36 of the braided sheath is adjacent to outer jacket 38 to prevent the copper wires of the braided sheath 32 from cutting the outer jacket 38 during flexing of the cable 10. The wall thickness of the outer jacket 38 is represented by 0.08×d+0.40 mm, where d is the diameter under the outer jacket.

The cable 10 of the invention is particularly useful as power cables between motor control devices, such as variable frequency drives and the motors they control. The insulation material over the power conductors 12 is selected to handle voltage and current spikes which may occur in such applications. Further, the trefoil or "3+3" arrangement of the power conductors and the grounding conductors together with the braided sheath reduces EMI/RFI interference. The entire cable 10 is constructed and arranged to be strong, yet flexible and may be used in robotics and festooning applications. It can be used in flexing and forced guided applications.

The above explanations include the provisions for the hard usage version of the cable which is called Rondoflex EMV and which is the same cable except the materials are changed to handle the environmental stresses of being outdoors. EPR is the insulation and EPR/Neoprene are the jacket materials. The concept of a low EMI/RFI motor cable is the same. The 3+3 design with an overall braided shield is utilized. The materials have been selected to specifically handle the voltage stresses associated with variable frequency drives.

It has been seen that the objects of this invention have been full and effectively accomplished. It will be realized, however, that the foregoing preferred embodiments have been shown and described for the purposes of illustrating the as structural and functional principles of the present invention, as well as illustrating the methods of employing the preferred embodiments and are subject to change without departing from such principles. Therefore, this invention includes all modifications encompassed within the spirit of the following claims.

We claim:

1. A flexible power cable comprising:

a plurality of power conductors, each having insulation thereon and being arranged to form interstices between adjacent ones of said power conductors, each of said power conductors comprising a plurality of conductor strands, a plurality of grounding conductors each having insulation thereon and each being disposed in an interstice, said grounding conductors and said power conductors defining a conductor bundle, an inner jacket surrounding said conductor bundle, a flexible, braided sheath member surrounding said inner jacket and being constructed and arranged to limit transmission and susceptibility to electromagnetic and radio frequency interference, and an outer jacket surrounding said braided sheath member, wherein the insulation of said power conductors and the insulation of said grounding conductors are lubricated so that said power conductors and said grounding conductors may move relative to each other and with respect to said inner jacket upon flexing of said cable.

2. The flexible power cable according to claim 1, wherein said insulation on each of said power conductors and each of said grounding conductors is cross-linked polyethylene.

3. The flexible power cable according to claim 2, wherein said insulation of said power conductors and of said grounding conductors has a lubricant coated thereon.

4. The flexible power cable according to claim 3, wherein said lubricant is talc.

5. The flexible power cable according to claim 1, wherein said insulation on each of said power conductors and each of said grounding conductors is cross-linked polyethylene, and said cross-linked polyethylene including a lubricant therein thereby defining said lubricated power conductors and grounding conductors.

6. The flexible power cable according to claim 1, wherein said plurality of insulated power conductors is three and said three power conductors are disposed in a trefoil arrangement.

7. The flexible power cable according to claim 6, wherein said plurality of grounding conductors is three and said three grounding conductors are disposed in a trefoil arrangement.

8. The flexible power cable according to claim 6, further comprising a support messenger disposed in a central opening defined between said three adjacent insulated power conductors, said support messenger being constructed and arranged to prevent said three power conductors from collapsing on each other.

9. The flexible power cable according to claim 1, wherein said insulation of each of said power conductors has a thickness sufficient to withstand stresses occurring from voltage and current spikes through said power conductors.

10. The flexible power cable according to claim 1, wherein said braided sheath member comprises braided tinned copper wires.

11. The flexible power cable according to claim 10, wherein said braided sheath further comprises a foil layer adjacent said inner jacket, and a plastic coating on said braided tinned copper wires adjacent said outer jacket.

12. The flexible power cable according to claim 1, wherein each of said inner and said outer jackets is a polyvinyl chloride jacket.

13. The flexible power cable according to claim 1, constructed and arranged to have a voltage rating generally between 600 and 1000 volts.

14. The flexible power cable according to claim 1, wherein said insulation on each of said power conductors and each of said grounding conductors comprises a thermoplastic or elastomeric material.

15. The flexible power cable according to claim 1, wherein said insulation on each of said power conductors and each of said grounding conductors comprises a thermoplastic or elastomeric material and said insulation including a lubricant therein thereby defining said lubricated power conductors and grounding conductors.

16. The flexible power cable according to claim 14 or 15, wherein said thermoplastic material is cross-linked polyethylene.

17. The flexible power cable according to claim 14 or 15 wherein said elastomeric material is ethylene propylene rubber (EPR).

18. The flexible power cable according to claim 1, wherein in the hard usage design said inner jacket is ethylene propylene rubber (EPR) and said outer jacket is chloroprene rubber (PCP).

* * * * *